US005241560A

United States Patent [19]

Omori et al.

[11] Patent Number: 5,241,560

[45] Date of Patent: Aug. 31, 1993

[54] CRUCIBLE INDUCTION FURNACE PROVIDED WITH A PREVENTIVE MEASURE AGAINST LOW MELTING POINT METALS

[75] Inventors: Tsuguharu Omori; Michio Kawasaki; Shizuo Hayashi, all of Kawasaki, Japan

[73] Assignee: Fuji Electric Co., Ltd., Kanagawa, Japan

[21] Appl. No.: 739,065

[22] Filed: Aug. 1, 1991

[30] Foreign Application Priority Data

Aug. 1, 1990 [JP] Japan ..... 2-204632

[51] Int. Cl.[5] ..... H05B 5/12

[52] U.S. Cl. ..... 373/145; 373/138; 373/139; 266/242; 266/275

[58] Field of Search ..... 373/138, 139, 145, 75, 373/76, 118, 137, 155, 156, 157, 158, 140, 151, 152, 154; 266/242, 275; 432/233

[56] References Cited

U.S. PATENT DOCUMENTS

| | | | |
|---|---|---|---|
| 1,922,029 | 8/1933 | Chesnut | 373/145 |
| 3,660,585 | 5/1972 | Waldron | 373/138 |
| 3,663,730 | 5/1972 | Gates | 373/152 |
| 3,751,571 | 8/1973 | Burrows | 373/155 |
| 3,822,873 | 7/1974 | Pletscher | 266/33 R |
| 4,205,197 | 5/1980 | Omori et al. | 373/145 |
| 4,241,232 | 12/1980 | Gelsing | 373/138 |
| 4,339,625 | 7/1982 | Delassus et al. | 373/158 |
| 4,658,404 | 4/1987 | Sick et al. | 373/143 |
| 4,745,620 | 5/1988 | Mortimer | 373/152 |
| 4,989,218 | 1/1991 | Tateno | 373/145 |
| 5,109,389 | 4/1992 | Stenzel | 373/156 |

FOREIGN PATENT DOCUMENTS

| | | |
|---|---|---|
| 58-7278 | 8/1983 | Japan . |
| 62-182568 | 10/1987 | Japan . |
| 63-101792 | 2/1988 | Japan . |
| 1540494 | 6/1975 | United Kingdom . |

*Primary Examiner*—Bruce A. Reynolds
*Assistant Examiner*—Tu Hoang
*Attorney, Agent, or Firm*—Finnegan, Henderson, Farabow, Garrett & Dunner

[57] ABSTRACT

A crucible induction furnace is disclosed which is provided with a preventive measure against low melting point metals and having a crucible refractory within an induction coil in a barrel container, in which the crucible induction furnace comprises a coil protection member located between the crucible refractory and the induction coil and which includes at least one air-permeating portion. An air supply pipe is in communication with the air-permeating portion for supplying pressurized air to the crucible refractory. The air permeating portion is disposed to distribute pressurized air having a higher pressure adjacent to the bottom portion of the crucible refractory than to the upper portion of the crucible refractory.

10 Claims, 3 Drawing Sheets

CRUCIBLE INDUCTION FURNACE PROVIDED WITH A PREVENTIVE MEASURE AGAINST LOW MELTING POINT METALS

BACKGROUND OF THE INVENTION

The invention relates to a crucible induction furnace provided with a preventive measure against low melting point metals.

There is a recent tendency for scraps or the like of galvanized steels and which are to be used in automobiles and washing machines to improve their corrosion resistance and which are to be melted in crucible induction furnaces.

FIG. 6 is a sectional view showing a main portion of a conventional example. When a steel containing zinc is melted at about 1500° C. in a crucible induction furnace 1 that is made up of a crucible refractory 2 and an induction coil 3, the zinc 5 in the molten metal bath 4 is susceptible to permeation through the crucible refractory 2 due to the static pressure $P_{S1}$ as shown in FIG. 6, thus reaching the induction coil 3. As the reaching amount of zinc increases, the induction coil 3 may be burnt by the heated zinc 5 or, may, in the worst case, cause a hydrogen explosion due to its contact with water in a cooling coil.

To detect such undesirable conditions while charging a molten metal into the furnace, a molten metal leakage sensor is arranged on the inner surface of the induction coil 3. Such a sensor is disclosed in, e.g., Japanese Utility Model Unexamined Publications Nos. 101792/1988 and 182568/1987, and Japanese Utility Model Examined Publication No. 7278/1983.

The melting point of zinc is 420° C. and its evaporating temperature is 920° C., while the melting temperature of cast iron is about 1500° C. Thus, in the crucible refractory 2 having a porosity of about 20%, it is likely that zinc in a gaseous state initially and in a liquid state as it permeates through the crucible refractory will eventually reach the outer side of the crucible refractory. Despite the fact that the crucible refractory 2 maintains its integrity without molten steel flashing, the permeation of the zinc therethrough causes the molten metal leakage sensor to operate erroneously or it burns and impairs the insulation of the induction coil 3 so as to reduce the refractory life.

In view of the above circumstances, a technique to check the permeation of low melting point metals is proposed in U.S. Pat. No. 4,989,218, in which gas passages consist of pipes providing holes and grooves inside the crucible refractory, and furthermore, consists of an additional lining of porous gas passages on the furnace wall, though not shown in the Figures.

SUMMARY OF THE INVENTION

An object of the invention is to provide a crucible induction furnace provided with a preventive measure against low melting point metals, in which the measure can block permeation of low melting point metals through a crucible refractory.

The present invention is applied to a crucible induction furnace provided with a preventive measure against low melting point metals and having a crucible refractory within an induction coil in a barrel container, the crucible induction furnace comprising: a coil protection member being laid between the crucible refractory and the induction coil and including at least one air-permeating portion; and an air supply pipe being in communication with the air-permeating portion for supplying a pressurized air to the crucible refractory from the outside of the barrel container; wherein the air permeating portion is disposed to distribute the pressurized air so that the pressure becomes higher in proportion to that adjacent to the bottom portion of the crucible refractory than at the upper portion of the crucible refractory.

A first aspect of the invention is applied to a crucible induction furnace provided with a preventive measure against low melting point metals, comprising: a lining member that is lined between a crucible refractory and an induction coil; an air-permeating member that is lined between the crucible refractory and the lining member; a porous member that is in direct communication with the gas-permeating member and disposed at a bottom portion of the crucible, the porous member having a porosity that is higher than a porosity of the air-permeating member; and an air supply pipe that is in communication with the porous member.

A second aspect of the invention is applied to a crucible induction furnace provided with a preventive measure against low melting point metals, which is made up of a coil protection member and a crucible refractory in an induction coil. In such a crucible induction furnace, the induction coil and the coil protection member are air-permeable in the inward and outward direction; the crucible induction furnace is accommodated airtightly in a barrel container; and an air supply pipe for supplying outside air is connected to the barrel container.

A third aspect of the invention is applied to a crucible induction furnace provided with a preventive measure against low melting point metals, which is made up of an induction coil and a crucible refractory. Such crucible induction furnace is accommodated airtightly in a bottom-closed barrel container with a lid that can be opened and closed, and an evacuating device is connected to an upper portion of the bottom-closed barrel container.

A fourth aspect of the invention is applied to a crucible induction furnace provided with a preventive measure against low melting point metals, in which the depth of a molten metal in the crucible is set to a value from 1.0 to 0.3 times the inner diameter of the crucible.

In the first aspect of the invention, although the porosity of the air-permeating member is not high as a result of the furnace building viewpoint, the air-permeating member is so arranged as to communicate with the air supply pipe through the porous member whose porosity is higher than its porosity. Therefore, the air permeability between the air-permeating member and the air supply pipe can be improved. Because the porous member is disposed at the bottom portion of the crucible refractory, the air supply pressure applied to the air-permeating member becomes larger at the bottom than at the bath surface, and this tendency is provided with a well balance to the static pressure of the molten liquid which is high in proportion to adjacent to the bottom of the bath and derives the permeability of the low melting point metals. As a result, the permeation blocking force, being proper, so as to prevent the air being wasted from around the bath surface by an excessive air supply pressure. The lining member out of the air-permeating member serves to prevent the supplied air from escaping toward the induction coil side.

In the second aspect of the invention, the air supplied into the airtight bottom-closed barrel container acts on the crucible refractory by passing through the induction coil and the coil protection members, both permeating the air inward and outward through small openings or the like to thereby block the permeation of gases and liquids of low melting point metals.

In the third aspect of the invention, the bottom-closed barrel container having a lid is evacuated by the evacuating device. Therefore, the low melting point and low evaporating point metals are evaporated and evacuated, thereby preventing their permeation through the crucible refractory.

In the fourth aspect of the invention (see FIGS. 4 and 6), the ratio of the depth of the molten metal in the bath to a total bath amount, i.e., the static pressure at the furnace bottom is set to a value from 1.0 to 0.3 times to the inner diameter of the crucible. This brings about a reduction of 1/1.3 to 1/5.3 compared with the conventional ratio that ranges from 1.3 to 1.6 times the inner diameter of the crucible, thereby contributing to reducing the permeation of low melting point metals.

DETAILED DESCRIPTION OF THE PREFERRED EMBODIMENT

Figure 1:
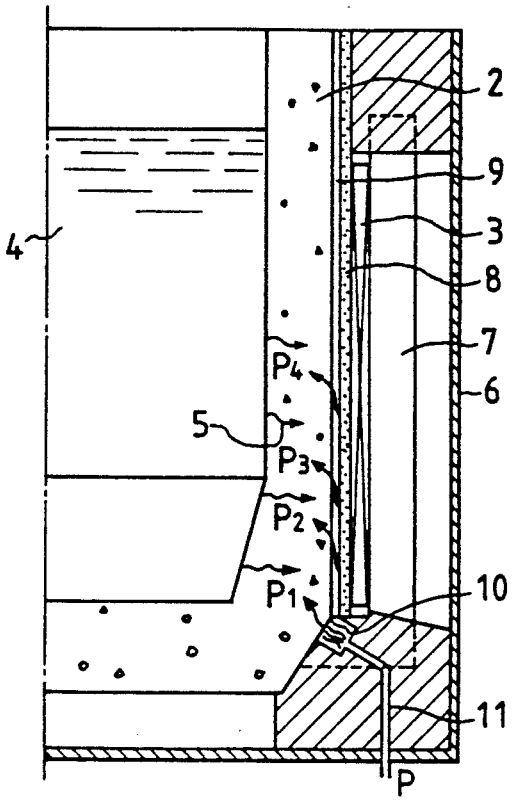
FIG. 1 is a sectional view showing a half of a first embodiment of the invention.
Figure 2A:
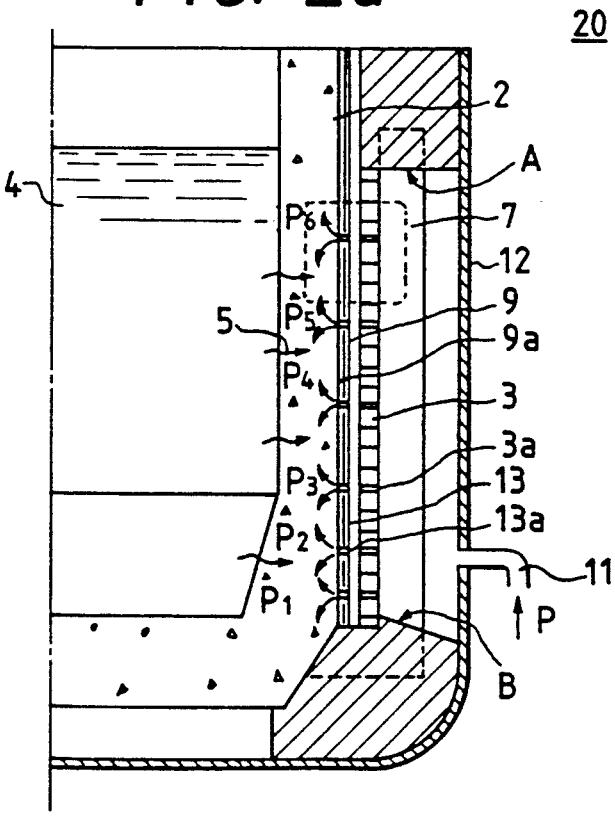
FIG. 2 is a sectional view showing a half of a second embodiment.
Figure 2B:
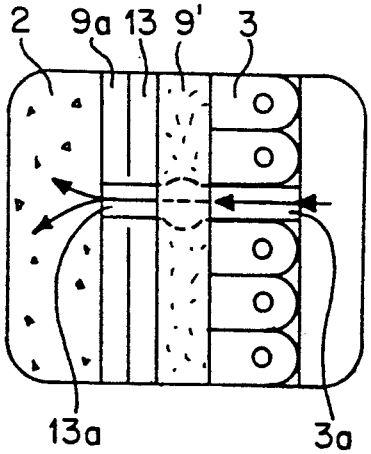
Figure 3:
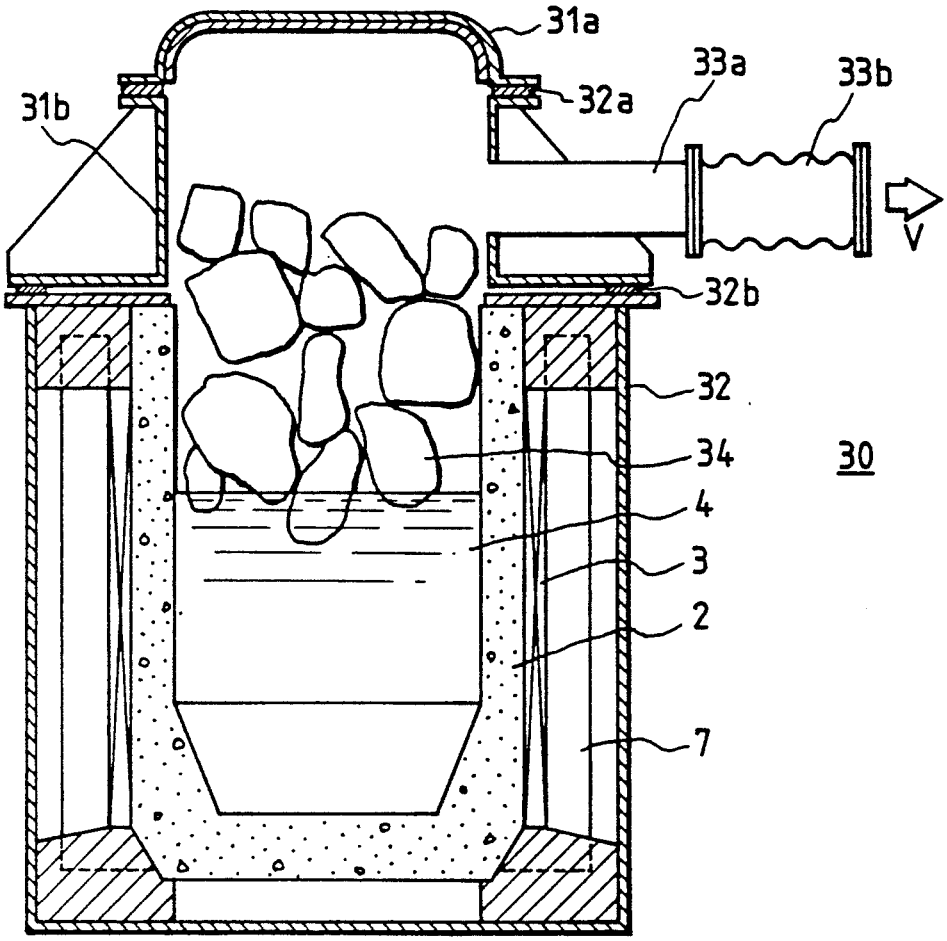
FIG. 3 is a sectional view showing a third embodiment.
Figure 4:
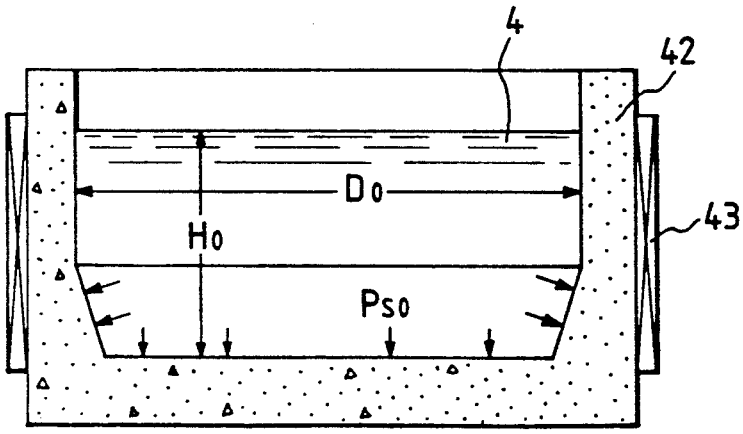
FIG. 4 is a sectional view showing a main portion of a fourth embodiment.
Figure 5:
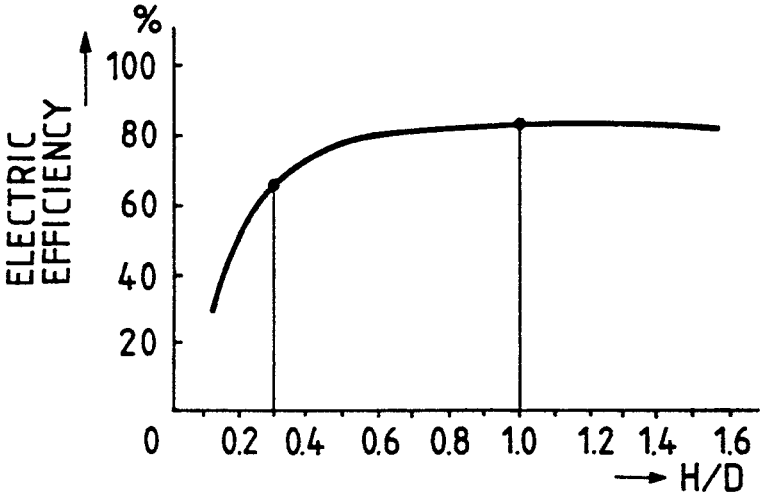
FIG. 5 is a curve of electric efficiency in heating versus a ratio of dimensions.

FIG. 1 is a sectional view showing a half of a first embodiment of the invention; FIG. 2 is a sectional view showing a half of a second embodiment; FIG. 3 is a sectional view of a third embodiment; FIG. 4 is a sectional view showing a main portion of a fourth embodiment; and FIG. 5 is an electric efficiency curve in heating versus a ratio of dimensions. The parts and components designated by the same reference numerals in the conventional example and in the figures have substantially the same functions, and their descriptions will in some cases be omitted. FIG. 5 is relevant to FIG. 4 to FIG. 6 which show a conventional example.

In FIG. 1, an induction coil 3 is disposed inside of a yoke 7 that is supported within a furnace frame 6. Between the induction coil 3 and a crucible refractory 2 are interposed two layers, the two layers being worked by special materials. Namely, the outside layer in the two layers is a lining member 8 made of coil cement which is comparatively dense, and the inside layer in the two layers is an air-permeating member 9 made of asbestos or glass fiber which is air-permeable and thermally resistant. At the bottom portion of the air-permeating member 9, a porous member 10 made of a porous brick is arranged along the entire periphery or along a partial arc, so that the porous member 10 comes in contact with the air-permeating member 9 on a large surface, making both members communicable through the air. The air-permeating member 9 communicates with an air supply pipe 11.

The air-permeating member 9, though air-permeable, is also relatively dense as it is a material for building the crucible refractory 2. Since it is so arranged that the air-permeating member 9 communicates with the air supply pipe 11 through the porous member 10 that is more porous than the member 9, the air-permeating member 9 allows the gas pressure to act on the crucible refractory 2 by supplying the air, $N_2$ gas, or Ar gas from the air supply pipe 11. While the presence of the lining member 8 serves to check the gas from leaking toward the induction coil side to a minimum possible level, the air-permeating member 9, being relatively dense and having a large resistance to the air, causes a larger gas pressure to be applied near a lower portion of the crucible refractory 2. That is, there exists such a relationship as $P_1 > P_2 > P_3 > P_4$ in FIG. 1. This tendency in pressure distribution matches the tendency in the static pressure distribution in a molten metal bath 4, and serves to effectively block the permeation of zinc 5 gas and liquid. As a result, the erroneous operation of a molten metal leakage sensor (not shown) and burning of the induction coil 3 due to the permeation of low melting point metals such as zinc are eliminated, and the crucible refractory 2 life is enhanced.

In the second embodiment shown in FIG. 2, a crucible induction furnace 20, which includes a crucible refractory 2, an induction coil 3, and a yoke 7, is accommodated in an airtight barrel container 12 having an air supply hole 11'. The induction coil 3 is provided with coil protection members. A coil protection member has small openings **13*a* interposed between the induction coil 3 and the crucible refractory 2. The induction coil 3 has small holes 3*a* for passing the pressurized gas through the coil. The coil protection members in this embodiment consist of: an air-permeating member 9' made of, e.g., coil cement; an asbestos board 9*a*; and a mica board 13. The mica board 13 has the small openings 13*a*. The coil protection members are not limited to the above examples, but may be made of asbestos used in the first embodiment or the like which are well known. It should be noted here that the coil cement is used as the lining member 8 in the first embodiment and as the air-permeating member 9' in the second embodiment. This is because the gas pressure is applied to the entire surface of the induction coil 3 in the second embodiment and because the gas pressure undergoes a drastic reduction when applied to the thin and long extending air-permeating member made of asbestos of the like in the first embodiment. In short, it is because the function to be performed by the coil cement differs depending on the action of the gas pressure in each embodiment. There exists such a relationship as $P_1 = P_2 \ldots = P_4$ in FIG. 2. The barrel container 12 ensures airtightness at upper and lower surfaces A and B. It is preferable to increase the small openings on the mica board 13** in proportion to adjacent to the bottom portion.

In the third embodiment shown in FIG. 3, a crucible induction furnace 30 is accommodated is an airtight fit in a barrel container 32 with lids **31*a*, 31*b* using gaskets 32*a*, 32*b* or the like, and is connected to a evacuating device (not shown) through a duct 33*a* of the lower lid 31*b* and a flexible duct 33*b*. Its negative pressure is preferably set to from 400 to 650 Torr, and the recovered metals can be reused. A material 34 is charged by opening the upper lid 31*a***.

By evacuating the barrel container with the lids using the evacuating device, low melting point and low evaporating point metals in steels or the like can be evaporated and evacuated, thereby preventing their permeation through the crucible refractory.

Figure 6:
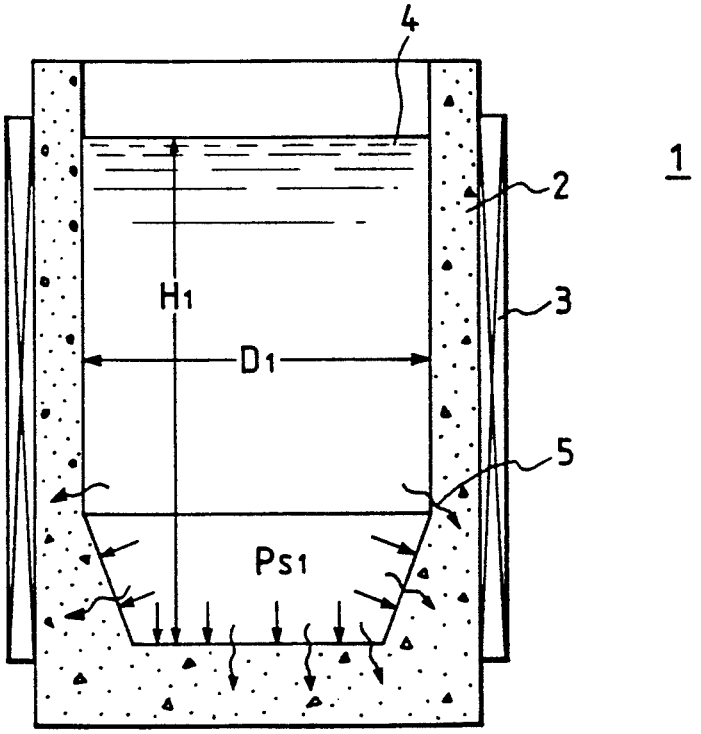
PRIOR ART FIG. 6
FIG. 6 is a sectional view showing a main portion of a conventional example.

With respect to the FIG. 5, in the fourth embodiment shown in FIG. 4, a comparison between the conventional example shown in FIG. 6 and this embodiment indicates that the ratio $H_0/D_0$ of a height $H_0$ of a molten metal bath 4 to an inner diameter $D_0$ of a crucible refractory 42 having an induction coil 43 is set to a value from 1.0 to 0.3, and a static pressure $P_{SO}$ of the furnace bottom is limited to a low value with the bath 4 at the same level.

In the conventional example shown in FIG. 6, it has conventionally been believed to have the ratio $H_1/D_1$ set to 1.3 to 1.6 so that a vertically long cylinder-like form of the crucible is obtained. Although the static pressure $P_{S1}$ is high and the permeating pressure of zinc is also high, the ratio H/D can be decreased by 1/1.3 to 1/5.3 if the crucible design is modified to the one shown in FIG. 4.

Since it is generally assumed that electric efficiency in heating tends to decrease with a smaller H/D, the large H/D has been given as described above. However, the relationship between the ratio H/D and the electric efficiency is as shown in FIG. 5, which suggests that there will be no drastic reduction in the electric efficiency unless the ratio H/D is drastically decreased. It is understood from FIG. 5 that the H/D limit stands at about 0.3.

According to this fourth embodiment, not only is the permeation of low melting point metals reduced, but also the large opening facilitates charging of the materials, thereby making it less likely to cause dangerous material bridging.

The crucible induction furnace provided with a preventive measure against low melting point metals according to the first or second aspect of the invention keeps in check the permeation of the gases or liquids of low melting point metals such as zinc through the crucible refractory by applying pressure to the crucible refractory from its outer periphery, thereby not only preventing the molten metal leakage sensor from operating erroneously and the insulation of the induction coil from burning, but also allowing the crucible to be used for a long period of time with an extension of the interval between furnace re-buildings.

The crucible induction furnace provided with a preventive measure against low melting point metals according to the third aspect of the invention, which comprises an induction coil and a crucible refractory, is accommodated airtightly in the bottom-closed barrel container with a lid that can be opened and closed, and the evacuating device is connected to an upper portion of the bottom-closed barrel container. Therefore, the evacuation of the bottom-closed barrel container with a lid by the evacuating device causes low melting point and low evaporating point metals in steels or the like to be evaporated and evacuated, thereby preventing their permeation through the crucible refractory.

The crucible induction furnace provided with a preventive measure against low melting point metals according to the fourth aspect of the invention has its bath level within the crucible set to a value from 1.0 to 0.3 times the inner diameter of the crucible. Therefore, the static pressure at the furnace bottom is reduced by 1/1.3 to 1/5.3 the conventional value, thereby contributing to preventing the permeation of the low melting point metals.

What is claimed is:

1. A crucible induction furnace provided with a preventive measure against low melting point metals and having a crucible refractory within an induction coil in a barrel container, said crucible induction furnace comprising:

a coil protection member located between said crucible refractory and said induction coil and including at least one air-permeating portion; and an air supply pipe in communication with said air-permeating portion for supplying pressurized air to said crucible refractory from outside of said barrel container;

wherein said air-permeating portion is disposed to distribute said pressurized air having a higher pressure at a bottom portion of said crucible refractory than at an upper portion of said crucible refractory.

2. A crucible induction furnace according to claim 1 wherein said coil protection member includes said air-permeating portion on an inner side and a lining member on an outer side, wherein said air-permeating portion includes a porous member having a porosity higher than the porosity of the other portion of said air-permeating portion and which is disposed at a bottom portion of said crucible refractory.

3. A crucible induction furnace according to claim 2 wherein said porous member is in communication with said air supply pipe.

4. A crucible induction furnace according to claim 2 wherein said porous member is made of a porous brick.

5. A crucible induction furnace according to claim 1 wherein said induction coil and said coil protection member are air-permeable in both inward and outward directions for said communication between said air supply pipe and said air-permeating portion; and said barrel container accommodates in an airtight fit said crucible induction furnace and is connected to said air supply pipe to form a chamber connecting said air supply pipe and said air-permeating portion.

6. A crucible induction furnace according to claim 5 wherein said coil protection member comprises small openings, and small holes are provided within said induction coil making said induction coil air-permeable.

7. The crucible induction furnace according to claim 1, wherein:

said barrel container is a bottom-closed barrel container having a lid capable of opening and closing, and said induction coil and said crucible refractory are being accommodated in an airtight fit in said bottom-closed barrel container; and said crucible induction furnace further comprises exhaust means connected to an upper portion of said bottom-closed barrel container for exhausting air inside said crucible induction furnace including a vapor of said low melting point metals.

8. A crucible induction furnace according to claim 7, wherein an exhaust pressure of said exhaust means is 400–650 torr.

9. A crucible induction furnace according to claim 1, said crucible refractory having an inner diameter and containing a liquid metal bath having a depth from 1.0 to 0.3 times said inner diameter.

10. A crucible induction furnace according to claim 6, wherein the number of said small openings in said coil protection member and said small holes provided within said induction coil increases in proximity to said bottom portion of said crucible refractory.

* * * * *